US006655798B2

(12) United States Patent
Temple

(10) Patent No.: US 6,655,798 B2
(45) Date of Patent: Dec. 2, 2003

(54) METHODS OF INKJET PRINTING

(75) Inventor: Stephen Temple, Impington (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/858,028

(22) Filed: May 15, 2001

(65) Prior Publication Data

US 2003/0067527 A1 Apr. 10, 2003

Related U.S. Application Data

(63) Continuation of application No. PCT/GB99/03883, filed on Nov. 22, 1999.

(30) Foreign Application Priority Data

Nov. 20, 1998 (GB) ..... 9825359

(51) Int. Cl.[7] ..... B41J 2/01
(52) U.S. Cl. ..... 347/101; 347/102
(58) Field of Search ..... 347/96, 98, 101–103, 347/105

(56) References Cited

U.S. PATENT DOCUMENTS

| | | | | |
|---|---|---|---|---|
| 5,635,969 A | | 6/1997 | Allen | 347/96 |
| 5,644,350 A | | 7/1997 | Ando et al. | 347/101 |
| 5,959,641 A | | 9/1999 | Yokoi | 347/21 |
| 6,158,834 A | * | 12/2000 | Kato et al. | 347/9 |
| 6,515,717 B1 | * | 2/2003 | Jiang et al. | 349/2 |
| 6,547,383 B2 | * | 4/2003 | Kuwahara | 347/101 |
| 2002/0015085 A1 | * | 2/2002 | Moriyama et al. | 347/101 |

FOREIGN PATENT DOCUMENTS

| | | | |
|---|---|---|---|
| EP | 0 277 703 A1 | 8/1988 | B41J/3/04 |
| EP | 0 278 590 A1 | 8/1988 | B41J/3/04 |
| EP | 0 422 870 A2 | 4/1991 | B41J/2/206 |
| EP | 0 657 849 A2 | 6/1995 | G06K/15/10 |
| EP | 0 671 268 A1 | 9/1995 | B41J/2/01 |
| EP | 0 847 872 A1 | 6/1998 | B41M/7/00 |
| JP | 8-72229 | 3/1996 | B41J/2/01 |
| WO | WO 95/25011 | 9/1995 | B41J/2/055 |
| WO | WO 97/04964 | 2/1997 | B41J/2/17 |

OTHER PUBLICATIONS

International Search Report in PCT/GB99/03883 dated Mar. 16, 2000.

International Preliminary Examination Report in PCT/GB99/03883 dated Feb. 2, 2001.

* cited by examiner

*Primary Examiner*—Stephen D. Meier
*Assistant Examiner*—Alfred E. Dudding
(74) *Attorney, Agent, or Firm*—Marshall, Gerstein & Borun LLP

(57) ABSTRACT

In ink jet printing, a UV curable undercoat is first deposited on a substrate. The ink and undercoat are cured together. The thickness of the undercoat varies inversely with the thickness of the ink, so that a flat print surface is achieved. Application of an undercoat may be disabled on text material, to preserve edge definition.

26 Claims, 1 Drawing Sheet

METHODS OF INKJET PRINTING

This is a continuation of International Application No. PCT/GB99/03883 filed Nov. 22, 1999, the entire disclosure of which is incorporated herein by reference.

The present invention relates to methods of inkjet printing.

There are a number of well-known inkjet printing techniques in which the number of ink droplets deposited per unit area is controlled to vary the optical density of printing. With multiple printheads, print colour can similarly be controlled.

A problem that is frequently encountered is that the final print quality is heavily dependent on whether and to what extent individual ink droplets spread on the substrate and coalesce with their neighbours. The behaviour of any one ink droplet in this respect is dependent to a considerable extent upon the number of other ink droplets being deposited in the same vicinity. Moreover, this behaviour is also influenced by microscopic variations in the mechanical and chemical properties of the substrate (especially the roughness of the substrate surface and the surface tension), so that the degree of spread and coalescing of droplets is not constant or reproducible, even where the pattern of neighbouring droplets is unchanging.

To provide a degree of control over the behaviour of ink droplets on the substrate, and indeed during the droplet deposition process, it is common to use inks that have a defined curing, fixing or hardening phase, such as ultraviolet curable ink. Whilst remaining within the inkjet printhead, during flight and for an initial interval upon the substrate, this liquid UV curable ink remains in what might be termed a "wet phase". At the appropriate time, the printed droplets are exposed to UV radiation, effecting through UV curing a transformation from the "wet phase" to a "dry phase". A similar effect can be achieved with hot melt inks where the transformation from "wet phase" to "dry phase" is controlled by temperature, or with dual-component inks where exposure to a hardening or fixing component effects the transformation. In this specification, the terms "wet" and "dry" will be employed to denote the respectively less and more viscous states of an ink or other printing material which has a defined curing, fixing or hardening phase.

It is an object of one aspect of the present invention to provide an improved method of inkjet printing in which the variability of droplet behaviour on the substrate is significantly reduced.

Accordingly, the present invention consists, in one aspect, in a method of ink jet printing on a substrate, comprising the steps of forming a wet undercoat layer on the substrate; depositing onto the undercoat layer, whilst the undercoat layer remains wet, a pattern of wet ink droplets and subsequently transforming the undercoat layer and deposited ink droplets to a dry state.

The undercoat layer may be formed using a variety of well known techniques, such as offset or bar coating, although it is preferably formed, wholly or in part, through ink jet printing.

The undercoat will typically be colourless, although this is not essential. A white undercoat may, for example, be useful in concealing colour variations over the substrate. If the undercoat is a different colour than the intended print substrate, there may be a requirement for further image processing of the print data prior to printing.

It is found that the spreading and coalescing of wet ink droplets on a wet undercoat is considerable more uniform and reproducible than on a bare substrate.

In many applications, the described problem of variable behaviour of deposited ink droplets is noticeable at certain densities of printing but not at others. It may be, for example that at low densities, the deposited ink droplets are sufficiently spaced that they never coalesce. At high densities, the ink droplets overlap sufficiently for them always to coalesce. It is over an intermediate range of densities that the problem of variable droplet behaviour produces noticeable artefacts.

Accordingly, in a preferred form of the invention, the step of forming a wet undercoat layer comprises the formation of a layer that varies spatially with the pattern of ink droplets to be deposited.

Suitably, the undercoat layer is formed on selected regions of the substrate but not on other regions, the selection of regions to receive an undercoat being dependent upon the pattern of ink droplets.

Advantageously, the thickness of the undercoat layer varies spatially with the pattern of ink droplets to be deposited.

When—for example—UV printing with 100% reactive inks, a glossy finish is usually produced. Reflected light from the surface reveals variations in thickness across the image.

It is observed that in such and certain other applications, the print quality can be further improved if the thickness of the undercoat layer varies generally inversely with the number of ink droplets to be deposited in a local region. In this way, it can be arranged that the total thickness of undercoat plus ink, remains sensibly constant over the substrate. This step is particularly beneficial where variations of print density are relatively gradual, such as in the printing of photographs or other images. Where there are high spatial frequencies in the print content—such as with text—and the desired changes in print density are abrupt rather than gradual, the step may be less beneficial or—indeed—harmful.

Thus, in a further form of the invention, the variation in the thickness of the undercoat layer with the pattern of deposited ink droplets, is disabled in regions where the print content to be represented by the pattern of ink is determined to comprise text or other high spatial frequency matter.

The invention will now be described by way of example with reference to the accompanying drawings, in which:

FIG. 1 is a diagram illustrating a method of ink jet printing in accordance with one aspect of the invention. In this example, the substrate is a plastic card shown at 100 and formed of PVC or ABS.

Figure 1:
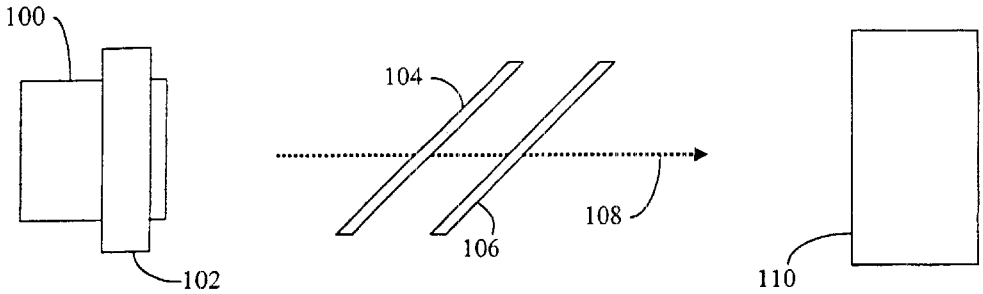
FIG. 1 is a diagram illustrating a method of ink jet printing in accordance with one aspect of the invention.

Firstly, an undercoat in the form of a thin layer of a UV curable carrier is applied to the substrate at undercoating station 102, in advance of ink jet printing.

Two ink jet printheads 104, 106 are angled to the substrate travel direction 108 to give 360 dpi resolution. The printheads are monochrome and print dark and light inks of a single colour respectively. The inks may for example have the same constituents but different proportions of pigment. The printheads may for example take any of the forms disclosed in EP-A-0 277 703 or EP-A-0 278 590 and are preferably arranged for multi tone printing as shown in EP-A-0 422 870, which specifications are all hereby incorporated by reference. The two printheads print wet-on-wet, and, after a delay determined by the distance to the UV lamp 110 and the print speed, the combined layer is cured. The delay before curing is typically less than one second. A typical cure energy is 1.25 J/cm$^2$ with a cure time of less than one second.

With this arrangement, it has been found possible to print a wedge of a single colour on a plastic card. By "wedge" is meant a solid block with the print colour varying continuously in the direction of printing. This is an exacting test of the ability of a printer to resolve small differences in colour or luminance without print artefacts. Using a method according to this invention, the printed wedge is found to be smooth having no visible dot structure and being closely linear. The results are subjectively of comparable quality to that obtained with offset lithography.

A key feature necessary to achieve this result is the wet undercoat layer. This allows drops to spread uniformly without regard to their neighbours. When printing on a dry substrate, spreading and merging of drops depends greatly on the amount of ink in neighbouring pixels. Use of a wet undercoat homogenises the behaviour.

A number of droplets from one or both printheads firing light and dark inks respectively are used to form a printed dot on the substrate. If each printhead is capable of firing n levels (that is to say n−1 drops per dot), there are a theoretical n$^2$ levels of tone. For example, for n=4, we have:

| | | | | | | | | | | | | | | | | |
|---|---|---|---|---|---|---|---|---|---|---|---|---|---|---|---|---|
| Drops of Ink. 1 | 0 | 1 | 2 | 3 | 0 | 1 | 2 | 3 | 0 | 1 | 2 | 3 | 0 | 1 | 2 | 3 |
| Drops of Ink. 2 | 0 | 0 | 0 | 0 | 1 | 1 | 1 | 1 | 2 | 2 | 2 | 2 | 3 | 3 | 3 | 3 |
| Resulting Tone: | 0 | 1 | 2 | 3 | 4 | 5 | 6 | 7 | 8 | 9 | 10 | 11 | 12 | 13 | 14 | 15 |

This number of levels can only be made available practically, if the behaviour on the substrate of the droplets from each printhead is carefully controlled. This is achieved by the use of a wet undercoat. Without such control, it has proved possible to use only some of the available levels.

Printing with all of these levels gives surprising results; as has been noted, print quality comparable with offset lithography is achievable. It will be recognised that the number of levels required to produce a desired print quality will vary according to the application.

In some cases, the counter-intuitive effect is observed of the darkness of the wedge reducing for increasing amounts of ink. This is a result of complex interactions between the droplets of the two inks, which remain even within the controlled substrate environment provided by the wet undercoat. Any such anomalous behaviour can be corrected according to a further aspect of the invention by measuring the density of the output tone for each of the used levels (as shown above) and applying these values as an inverse relationship to the picture values.

A combination of the features mentioned above has resulted in successful printing with twelve levels of two inks. However, there are further aspects of the invention which produce further improvement or simpler printing.

The use of light and dark inks of the same colour is not an essential feature of the invention; the use of a wet undercoat provides an advantage with a single printheads or with multiple printheads corresponding respectively with three, four, six or other known colour component schemes.

It is also possible to use a printhead of the kind disclosed in WO 95/25011 (which specification is hereby incorporated by reference) with firing pulses having a duration of less than L/c to produce "fractional" drops. This can be used (a) to reduce the size of the smallest dot (instead of using light ink), or (b) to linearise the tone curve as described above but by altering the waveform rather than the picture. This method has the further merit that it reduces the total ink put down and would therefore increase the total number of levels available from a given head arrangement. Suppose that it takes 7 droplets per dot to print full density using actuating waveforms of equal duration: if the duration of the actuating waveform used to eject the first droplet is halved, and others reduced between 0.5 and 1, then the total ink volume deposited by 7 droplets is now less and, instead, 10 or 12 dpd (droplets per print dot) might be required to reach full black. The performance of this simple head is comparable with a two-tone ink approach.

The undercoat can be applied by a roller or wiper or by a wide variety of other known techniques. In one form of this invention, however, a clear undercoat layer is deposited using a further ink jet printhead. The "tone" of this layer would be such as to "top up" the ink film where little is to be printed. For example, suppose the total ink allowed for all colours is 300%, then the undercoat printhead would print (300−C−M−Y−K−c−m−y−k), where C=dark cyan, c=light cyan etc.

A simple way of achieving a top up undercoat is to create a "luminosity" version of a picture (for example by converting a colour picture to grey using well known image processing software). This may be regarded as a map showing the amount of ink to be deposited at each point in the image. If this map is inverted (by subtraction from an appropriate fixed value), a desired depth map is then provided for the undercoat.

If the example is taken of monochrome printing (or a single component of a multi-component colour scheme), it is useful to control the number of ink dpd and undercoat dpd such that the aggregate number of dpd remains constant.

Figure 2:
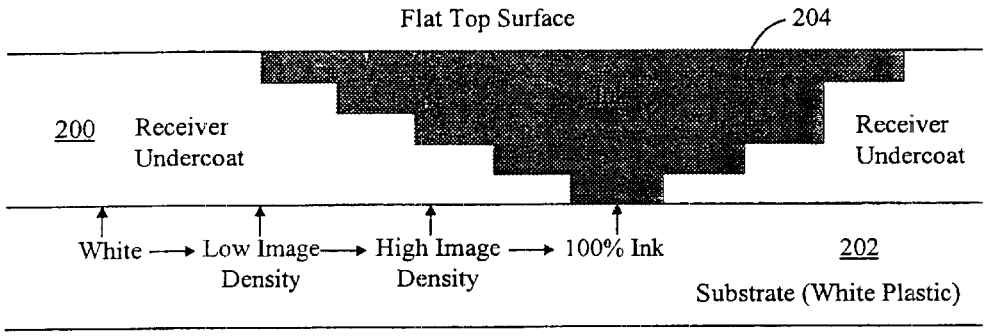
FIG. 2 is a schematic cross section through a substrate printed in accordance with one aspect of the invention.
Figure 3:
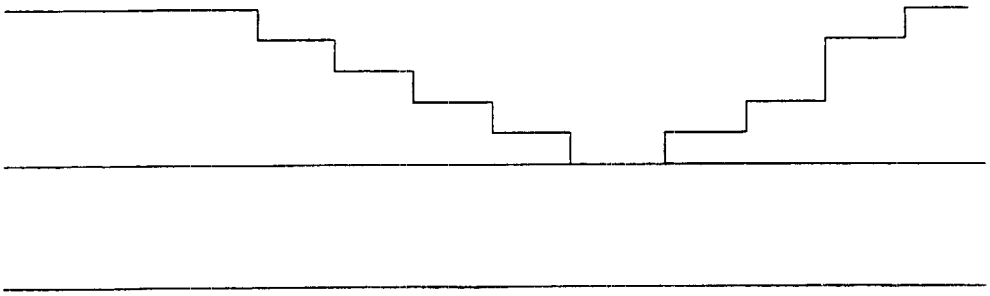
FIG. 3 is a cross section similar to FIG. 2, illustrating a modification.

Referring to FIG. 2, an arrangement is shown in which the thickness of the receiver undercoat 200 deposited onto the substrate 202 is varied with the thickness of ink 204 such that a constant overall thickness is achieved and, thereby, a flat top surface. In many applications, especially with plastic substrates, this is found to produce excellent print quality.

The controlled use of a binary ink system (ink+clear or white undercoat), such that the aggregate number of droplets per print dot is maintained sensibly constant, is felt to have important advantages. It will be recognised that the same technique can be applied to other binary systems in which the two components have different optical density, as well as to more complex systems having more than two components. The order in which the different components are deposited on the substrate may sometimes be varied. Thus a flat top surface could be achieved by the use of a clear top coat. It will be understood however that such an arrangement will not provide the advantages mentioned previously of a wet undercoat.

Whilst, the use of a wet undercoat (or a co-deposited clear component) offers important advantages, benefit can be achieved by the application of an undercoat which varies in thickness to accommodate the local ink thickness, even if that undercoat is not wet as the ink is deposited. As seen in FIG. 4, an undercoat layer can be applied to a substrate to provide "pits" to receive the necessary numbers of droplets from a downstream ink jet printhead.

It has been discovered many of the above-described techniques work differently with different types of print material. It is found for example that whilst the use of an undercoat is particularly effective in printing photographs or similar images, it is less effective (and indeed sometimes unhelpful) in text printing. In one embodiment of the invention, therefore, the nature of the print content is determined and the application of an undercoat is disabled in areas of text. This preserves edge definition. It has been found advantageous not print to undercoat wherever there is high frequency detail (whether arising from text or more generally), possibly extending this to a "halo" of dry base around the text or other region of high frequency detail. The print content may be analysed for this purpose using a spatial filtering technique to determine a map of regions where the use of an undercoat is to be disabled. That map can be spatially filtered to "spread" the uncoated area, for example by means of a simple FIR (Fixed Impulse Response) filter.

The undercoat used in the various examples described above may, if clear, take the form essentially of the diluent used in the corresponding ink.

An example is given in Table 1 below of a four colour ink scheme, with a white undercoat for use in accordance with the invention.

TABLE 1

(proportions by wt %)

| MATERIAL | BLACK | CYAN | MAGENTA | YELLOW | UNDERCOAT |
|---|---|---|---|---|---|
| ACTILANE 422 | — | — | — | — | 18.55% |
| ACTILANE 430 | 12.50% | 12.50% | 12.50% | 12.50% | — |
| ACTILANE 251 | 12.50% | 12.50% | 12.50% | 12.50% | 15.00% |
| TEGORAD 2200 | 0.40% | 0.40% | 0.40% | 0.40% | 0.40% |
| SARTOMER 506* | 39.70% | 40.00% | 38.35% | 41.48% | — |
| SARTOMER 306 | 23.00% | 22.90% | 23.00% | 22.0% | — |
| SPEEDCURE ITX | 2.00% | — | — | — | — |
| QUANTACURE EHA | 3.00% | — | — | — | — |
| IRGACURE 907 | 5.00% | — | — | — | 10% |
| REGAL 250R | 1.50% | — | — | — | — |
| SOLSPERSE 24000 | 0.38% | 0.60% | 0.75% | 0.30% | 1.05% |
| SOLSPERSE 5000 | 0.03% | 0.11% | — | — | — |
| IRGALITE BLUE GLVO | — | 1.00% | — | — | — |
| HOSTAPERM RED E5B 02 | — | — | 2.50% | — | — |
| PALIOTOL YELLOW D1155 | — | — | — | 0.75% | — |
| SOLSPERSE 22000 | — | — | — | 0.07% | — |
| LUCERIN TPO | — | 5.00% | 5.00% | 5.00% | — |
| DAROCURE 1173 | | 5.00% | 5.00% | 5.00% | |
| N-VINYL PYRROLIDONE | — | — | — | — | 20% |
| WHITE PIGMENT | — | — | — | — | 35% |

A further example is given in Table 2, below, of a monochrome, light and dark ink scheme with a clear undercoat.

TABLE 2

(proportions by wt %)

| MATERIAL | BLACK 1 | BLACK 2 | UNDERCOAT |
|---|---|---|---|
| SOLSPERSE 2400 | 0.38% | 0.76% | — |
| SOLSPERSE 5000 | 0.03% | 0.06% | — |
| ACTILANE 430 | 12.5% | 12.5% | 10.2% |
| ACTILANE 251 | 12.5% | 12.5% | 15.3% |
| SARTOMER 306 | 23% | 22.3% | 23.4% |

TABLE 2-continued (proportions by wt %)

| MATERIAL | BLACK 1 | BLACK 2 | UNDERCOAT |
|---|---|---|---|
| SARTOMER 506 | 39.7% | 38.5% | 40.9% |
| TEGORAD 2200 | 0.4% | 0.4% | — |
| LUCERIN TPO | — | 0% | 5.1% |
| DAROCURE 1173 | — | 0% | 5.1% |
| IRGACURE 907 | 5% | 5% | — |
| SPEEDCURE ITX | 2% | 2% | — |
| QUANTACURE EH | 3% | 3% | — |

It should be understood that this invention has been described by way of examples only and that a wide variety of modifications are possible without departing from the scope of the invention. Thus, whilst the invention has been particularly described with reference to UV curable inks and undercoats, the invention is applicable to hot melt inks, and other inks having defined wet and dry phases. A suitable undercoat will typically take the same form as the ink, with the pigment or other colourant removed or replaced by white pigment or other colourant.

What is claimed is:

1. A method of ink jet printing on a substrate, comprising the steps of forming a wet undercoat layer on the substrate; depositing onto the undercoat layer, while the undercoat layer remains wet, a pattern of wet ink droplets and subsequently transforming the undercoat layer and deposited ink droplets to a dry state, wherein the ink includes a diluent and the undercoat layer is formed essentially of the same diluent and both the ink and the undercoat layer are UV curable.

2. A method according to claim 1, comprising the step of forming the undercoat layer, at least in part, through ink jet printing.

3. A method according to claim 1, wherein the step of forming a wet undercoat layer comprises the step of forming a layer that varies spatially with the pattern of ink droplets to be deposited.

4. A method according to claim 3, comprising the step of forming the undercoat layer on selected regions of the substrate but not on other regions, the selection of regions to receive an undercoat being dependent upon the pattern of ink droplets.

5. A method according to claim 3, wherein the thickness of the undercoat layer varies spatially with the pattern of ink droplets to be deposited.

6. A method according to claim 1, wherein the thickness of the undercoat layer varies generally inversely with the number of ink droplets to be deposited in a local region.

7. A method according to claim 6, wherein the total thickness of undercoat plus ink remains sensibly constant over at least a region of the substrate.

8. A method according to claim 6, comprising the step of disabling the variation in the thickness of the undercoat layer with the pattern of deposited ink droplets in regions where the print content to be represented by the pattern of ink is determined to comprise text or other high spatial frequency matter.

9. Ink jet printing apparatus comprising a substrate path; an undercoat station for forming a UV curable undercoat layer on a substrate; at least one ink jet printhead positioned downstream of the undercoat station in the substrate path for depositing ink droplets onto the undercoat whilst while it remains wet; and a UV curing station downstream in the substrate path of the at least one printhead.

10. A method of ink jet printing on a substrate, comprising the steps of ink jet printing an undercoat layer on the substrate, the thickness of that layer varying across the substrate in accordance with the thickness of the ink to be deposited, and ink jet printing ink onto the undercoat, wherein the thickness of the undercoat layer varies generally inversely with the number of ink droplets deposited in a local region.

11. A method according to claim 10, further comprising the step of signal processing a print data file to provide a luminance map indicative of the thickness of the ink to be deposited; and utilising utilizing said luminance map to determine the desired thickness of undercoat.

12. A method according to claim 10, wherein the undercoat layer remains wet as the ink droplets are deposited.

13. A method according to claim 10, comprising the step of forming the undercoat layer on selected regions of the substrate but not on other regions, the selection of regions to receive an undercoat being dependent upon the pattern of ink droplets.

14. A method according to claim 10, wherein the thickness of the undercoat layer varies generally inversely with the number of ink droplets to be deposited in a local region.

15. A method according to claim 14, wherein the total thickness of undercoat plus ink remains sensibly constant over the substrate.

16. A method according to claim 14, comprising the step of disabling the variation in the thickness of the undercoat layer with the pattern of deposited ink droplets in regions wherein the print content to be represented by the pattern of ink is determined to comprise text or other high spatial frequency matter.

17. A method according to claim 10, wherein the variation in thickness of the undercoat layer serves to define pits for receiving droplets of ink.

18. A method of ink jet printing utilizing at least two print components having different optical density, comprising the steps of depositing at respective elemental print areas varying numbers of droplets of the respective print components, wherein the relative numbers of ink droplets from the respective print components are controlled to produce the desired print density and wherein the aggregate number of droplets deposited at each elemental print area is substantially constant.

19. A method according to claim 18, wherein one print component is clear.

20. A method according to claim 18, wherein one print component defines a white undercoat.

21. A method according to claim 18, wherein one print component defines a clear topcoat.

22. A method of ink jet printing on a substrate, comprising the steps of forming a wet undercoat layer on the substrate, depositing onto the undercoat layer, while the undercoat layer remains wet, a pattern of wet ink droplets and subsequently transforming the undercoat layer and deposited ink droplets to a dry state, and wherein the step of forming the undercoat layer comprises the step of forming a layer that varies spatially with the pattern of ink deposited wherein the spatial variation is the thickness of the undercoat layer and wherein the thickness of the undercoat layer varies generally inversely with the number of ink droplets to be deposited in a local region.

23. A method according to claim 22, wherein the total thickness of undercoat plus ink remains sensibly constant over at least a region of the substrate.

24. A method according to claim 22, further comprising the step of disabling the variation in the thickness of the undercoat layer with the pattern of deposited ink droplets in regions where the print content to be represented by the pattern of ink is to comprise text or other high spatial frequency matter.

25. A method according to claim 22, wherein the undercoat layer is UV curable.

26. A method of ink jet printing on a substrate, the method comprising the steps of:

ink jet printing an undercoat layer on the substrate, the thickness of that layer varying across the substrate in accordance with the thickness of the ink to be deposited;

ink jet printing ink onto the undercoat;

signal processing a print data file to provide a luminance map indicative of the thickness of the ink to be deposited; and utilizing said luminance map to determine the desired thickness of the undercoat.

* * * * *

UNITED STATES PATENT AND TRADEMARK OFFICE

CERTIFICATE OF CORRECTION

PATENT NO. : 6,655,798 B2
DATED : December 2, 2003
INVENTOR(S) : Temple, Stephen It is certified that error appears in the above-identified patent and that said Letters Patent is hereby corrected as shown below:

Title page,
Item [75], Inventors, delete “Impington” and insert -- Cambridge --.

Column 7,
Line 23, delete “whilst while” and insert -- while --.
Line 37, delete “ulitising ulitizing” and insert -- utilizing --.

Column 8,
Line 39, delete “is to comprise” and insert -- is determined to comprise --.

Signed and Sealed this

Seventh Day of June, 2005

JON W. DUDAS
*Director of the United States Patent and Trademark Office*